US010500749B2

(12) United States Patent
Lin

(10) Patent No.: US 10,500,749 B2
(45) Date of Patent: Dec. 10, 2019

(54) CUTTING MACHINE

(71) Applicant: Ming-Yu Lin, Taichung (TW)

(72) Inventor: Ming-Yu Lin, Taichung (TW)

( * ) Notice: Subject to any disclaimer, the term of this patent is extended or adjusted under 35 U.S.C. 154(b) by 5 days.

(21) Appl. No.: 15/601,808

(22) Filed: May 22, 2017

(65) Prior Publication Data

US 2018/0065267 A1 Mar. 8, 2018

(30) Foreign Application Priority Data

Sep. 8, 2016 (TW) ..... 105213860 U

(51) Int. Cl.

| | |
|---|---|
| ***B26D 3/22*** | (2006.01) |
| ***B26D 1/00*** | (2006.01) |
| ***B26D 1/38*** | (2006.01) |
| ***B26D 1/34*** | (2006.01) |
| ***B26D 5/10*** | (2006.01) |

(52) U.S. Cl.

CPC ..... *B26D 3/225* (2013.01); *B26D 1/0006* (2013.01); *B26D 1/38* (2013.01); *B26D 1/34* (2013.01); *B26D 3/22* (2013.01); *B26D 5/10* (2013.01); *B26D 2001/0066* (2013.01)

(58) Field of Classification Search

CPC ..... B26D 3/225; B26D 1/0006; B26D 1/38; B26D 1/34; B26D 3/22; B26D 5/10; B26D 2001/0066; B26D 1/00

See application file for complete search history.

(56) References Cited

U.S. PATENT DOCUMENTS

| | | | | | |
|---|---|---|---|---|---|
| 72,709 | A * | 12/1867 | Williams | B27B 27/02 | 83/468.7 |
| 213,089 | A * | 3/1879 | Beck | B26D 1/08 | 83/643 |
| 1,274,551 | A * | 8/1918 | Hoyt | B23D 15/08 | 83/646 |
| 1,307,552 | A * | 6/1919 | Johnson | B23D 15/08 | 83/646 |
| 1,524,823 | A * | 2/1925 | Henesey | B23D 35/005 | 83/624 |
| 1,805,163 | A * | 5/1931 | Buckner | C14B 5/04 | 83/642 |
| 1,814,151 | A * | 7/1931 | Gundlach | B28D 1/223 | 83/589 |
| 1,906,599 | A * | 5/1933 | Hoffert | B28D 1/223 | 83/589 |
| 3,263,548 | A * | 8/1966 | Kobler | B23D 15/06 | 83/633 |

(Continued)

*Primary Examiner* — Jonathan G Riley

(57) ABSTRACT

A cutting machine includes a platform, two supporting elements, a guiding plate, a handle and a blade assembly. The supporting elements are supported on the platform. Each of the supporting elements includes a space. The guiding plate is inserted in the space of the first supporting element and includes a slot. The handle includes a pivoting plate and an axle. The pivoting plate is inserted in the space of the second supporting element, and includes a primary aperture and a secondary aperture. The axle is inserted in the primary aperture of the pivoting plate and an aperture of the second supporting element. The blade assembly includes a blade and two pins. The first pin is inserted in an aperture of the blade and movably inserted in the slot. The second pin is inserted in another aperture of the blade and the secondary aperture of the pivoting plate.

12 Claims, 12 Drawing Sheets

(56) References Cited

U.S. PATENT DOCUMENTS

| | | | | | |
|---|---|---|---|---|---|
| 3,780,436 | A * | 12/1973 | Pellman | B26D 1/0006 | 30/123 |
| 4,463,693 | A * | 8/1984 | Dreier | D05B 37/063 | 112/128 |
| 2004/0089126 | A1* | 5/2004 | McLean | B26D 1/08 | 83/605 |
| 2011/0174130 | A1* | 7/2011 | Zhang | B26D 1/12 | 83/602 |
| 2011/0214549 | A1* | 9/2011 | Shih | B26D 5/10 | 83/606 |
| 2013/0014618 | A1* | 1/2013 | Wu | B25B 7/123 | 81/379 |
| 2013/0276609 | A1* | 10/2013 | Hatakeyama | B26D 1/305 | 83/582 |
| 2014/0041175 | A1* | 2/2014 | Tsai | B26D 1/30 | 29/56.6 |
| 2017/0197326 | A1* | 7/2017 | Xu | B26D 5/10 | |

* cited by examiner

CUTTING MACHINE

BACKGROUND OF INVENTION

1. Field of Invention

The present invention relates to a cutting machine and, more particularly, to an efficient cutting machine.

2. Related Prior Art

A cutting machine is often used in an office to cut a piece of paper into smaller pieces. A conventional cutting machine includes a blade assembly supported on a platform. The blade assembly includes a stationary blade and a movable blade. Each of the stationary and movable blades includes a cutting edge. When the movable supporting element is pressed down, the cutting edges of the stationary and movable blades cut and, more particularly, shear the piece of paper. The conventional cutting machine is popular for convenience, safety and effectiveness. However, it is difficult to use the conventional cutting machine to cut a book or a magazine that is thick.

The present invention is therefore intended to obviate or at least alleviate the problems encountered in prior art.

SUMMARY OF INVENTION

It is the primary objective of the present invention to provide an efficient cutting machine.

To achieve the foregoing objective, the cutting machine includes a platform, two supporting elements, a guiding plate, a handle and a blade assembly. The supporting elements are supported on the platform. Each of the supporting elements includes a space. The guiding plate is inserted in the space of the first supporting element and includes a slot. The handle includes a pivoting plate and an axle. The pivoting plate is inserted in the space of the second supporting element, and includes a primary aperture and a secondary aperture. The axle is inserted in the primary aperture of the pivoting plate and an aperture of the second supporting element. The blade assembly includes a blade and two pins. The first pin is inserted in an aperture of the blade and movably inserted in the slot. The second pin is inserted in another aperture of the blade and the secondary aperture of the pivoting plate.

Other objectives, advantages and features of the present invention will be apparent from the following description referring to the attached drawings.

BRIEF DESCRIPTION OF DRAWINGS

The present invention will be described via detailed illustration of the preferred embodiment referring to the drawings wherein.

DETAILED DESCRIPTION OF PREFERRED EMBODIMENT

Figure 1:
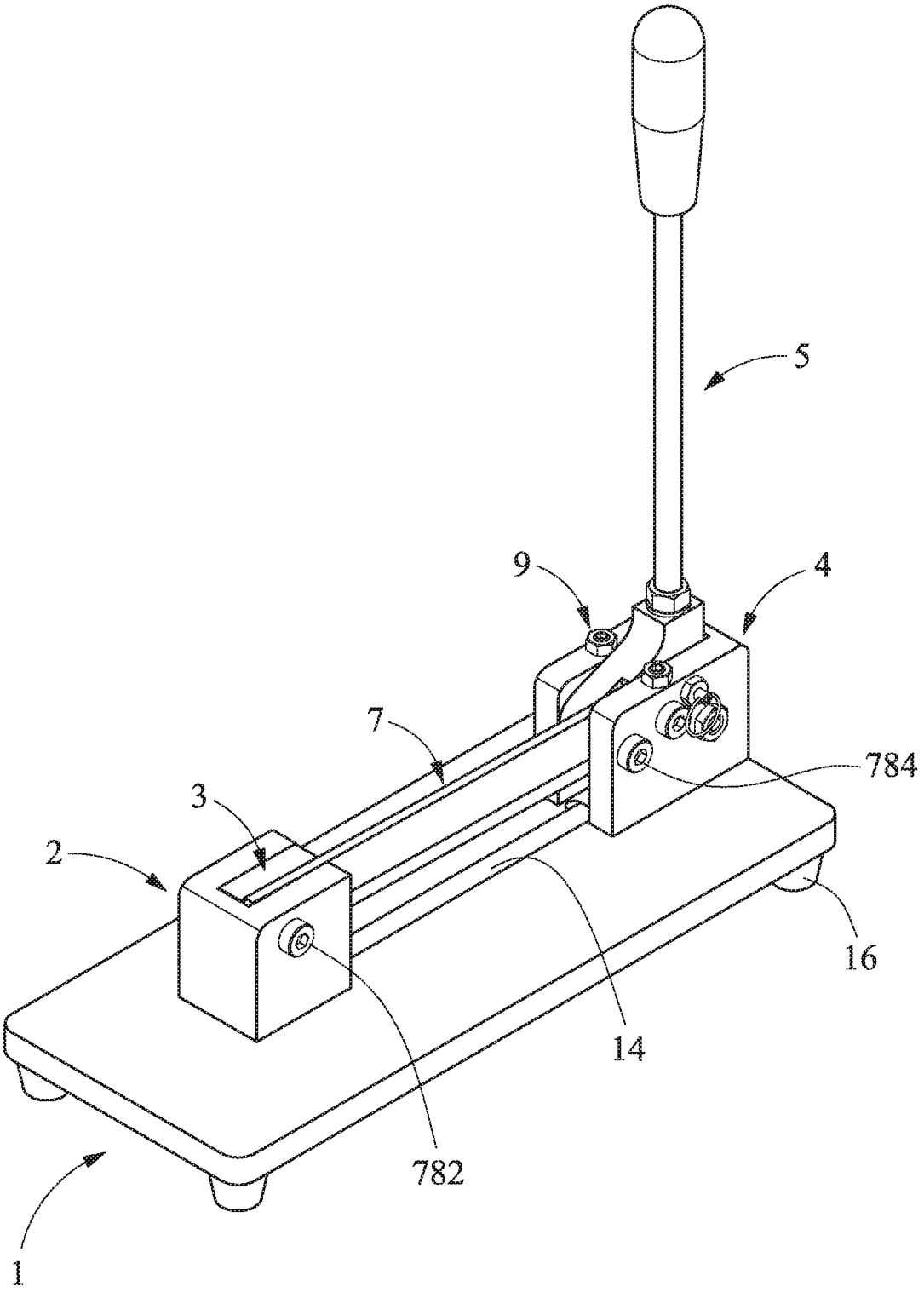
FIG. 1 is a perspective view of a cutting machine according to the preferred embodiment of the present invention.

Referring to FIGS. 1 through 13, a cutting machine includes a basic assembly 1, two supporting elements 2 and 4, a guiding plate 3, a handle 5, a safety assembly 6, a blade assembly 7 and two adjusting assemblies 8 and 9 according to the preferred embodiment of the present invention.

Figure 2:
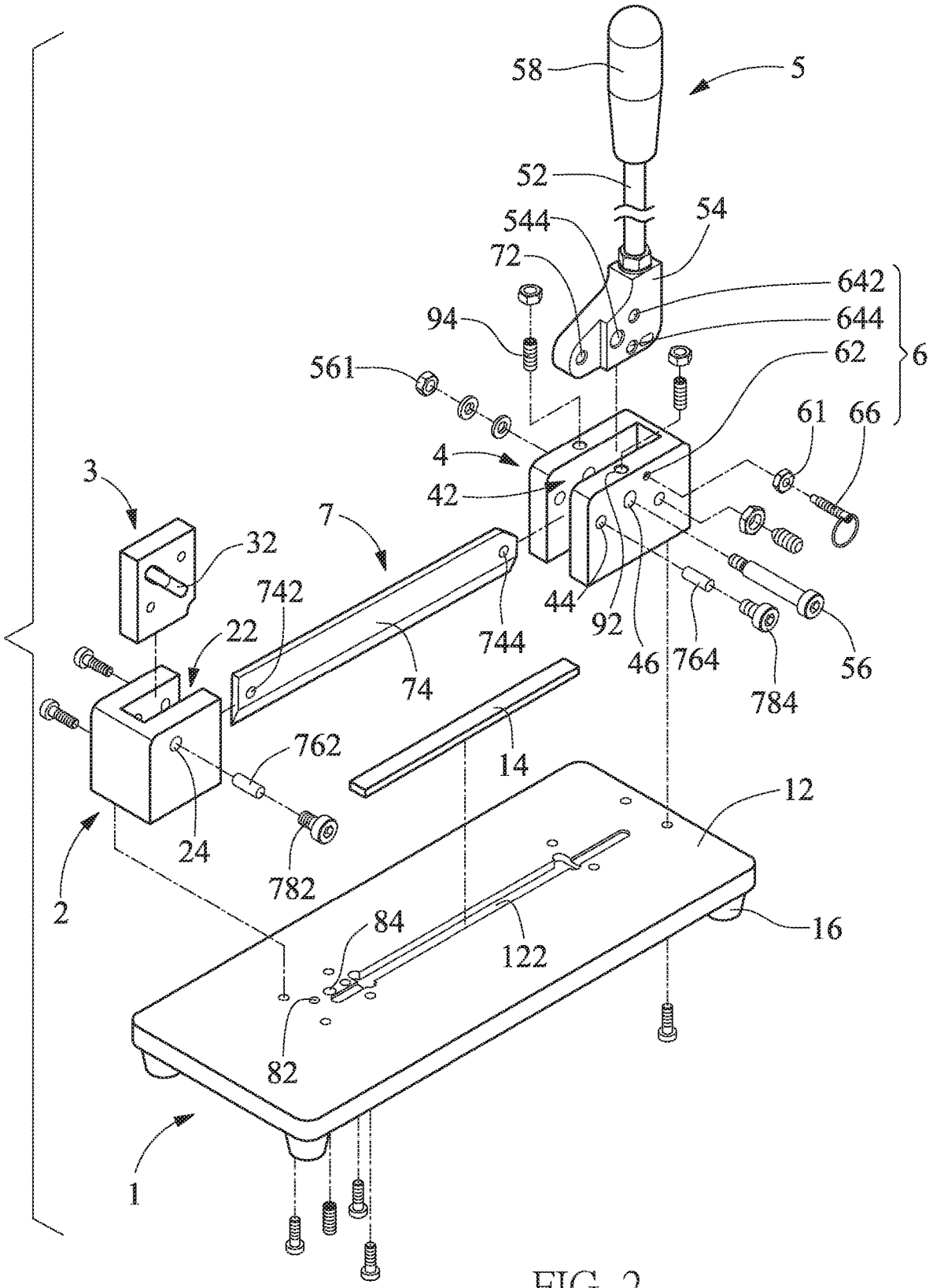
FIG. 2 is an exploded view of the cutting machine shown in FIG. 1.
Figure 3:
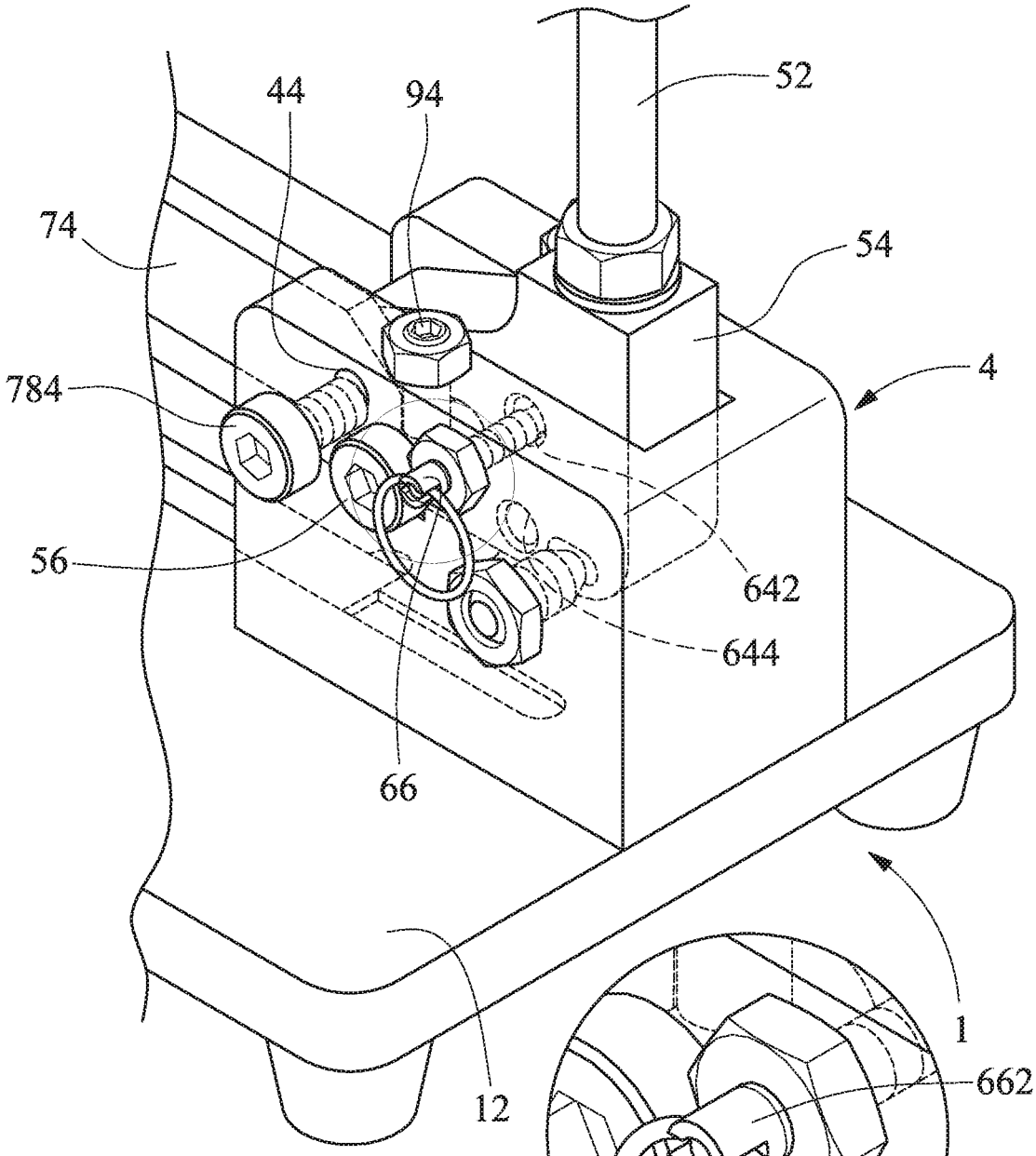
FIG. 3 is an enlarged partial view of the cutting machine of FIG. 1.
Figure 13:
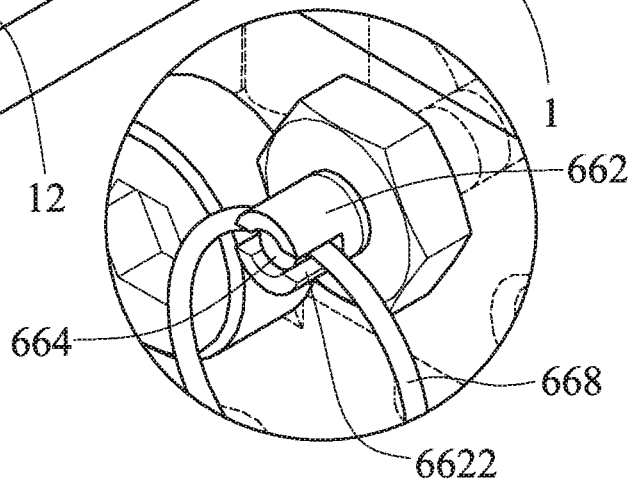
FIG. 13 is an enlarged partial view of the cutting machine of FIG. 3.
Figure 4:
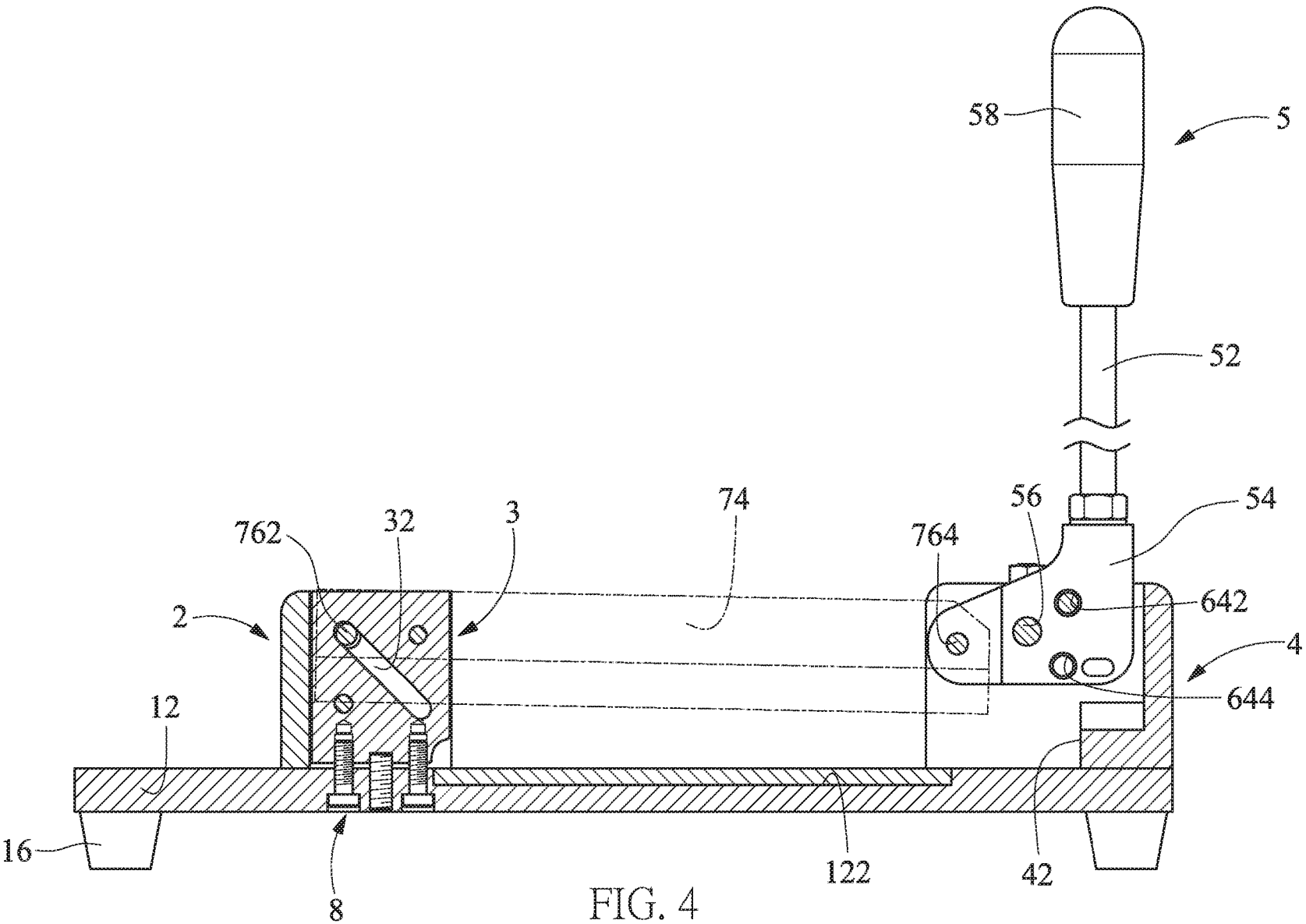
FIG. 4 is a cross-sectional view of the cutting machine shown in FIG. 1.
Figure 5:
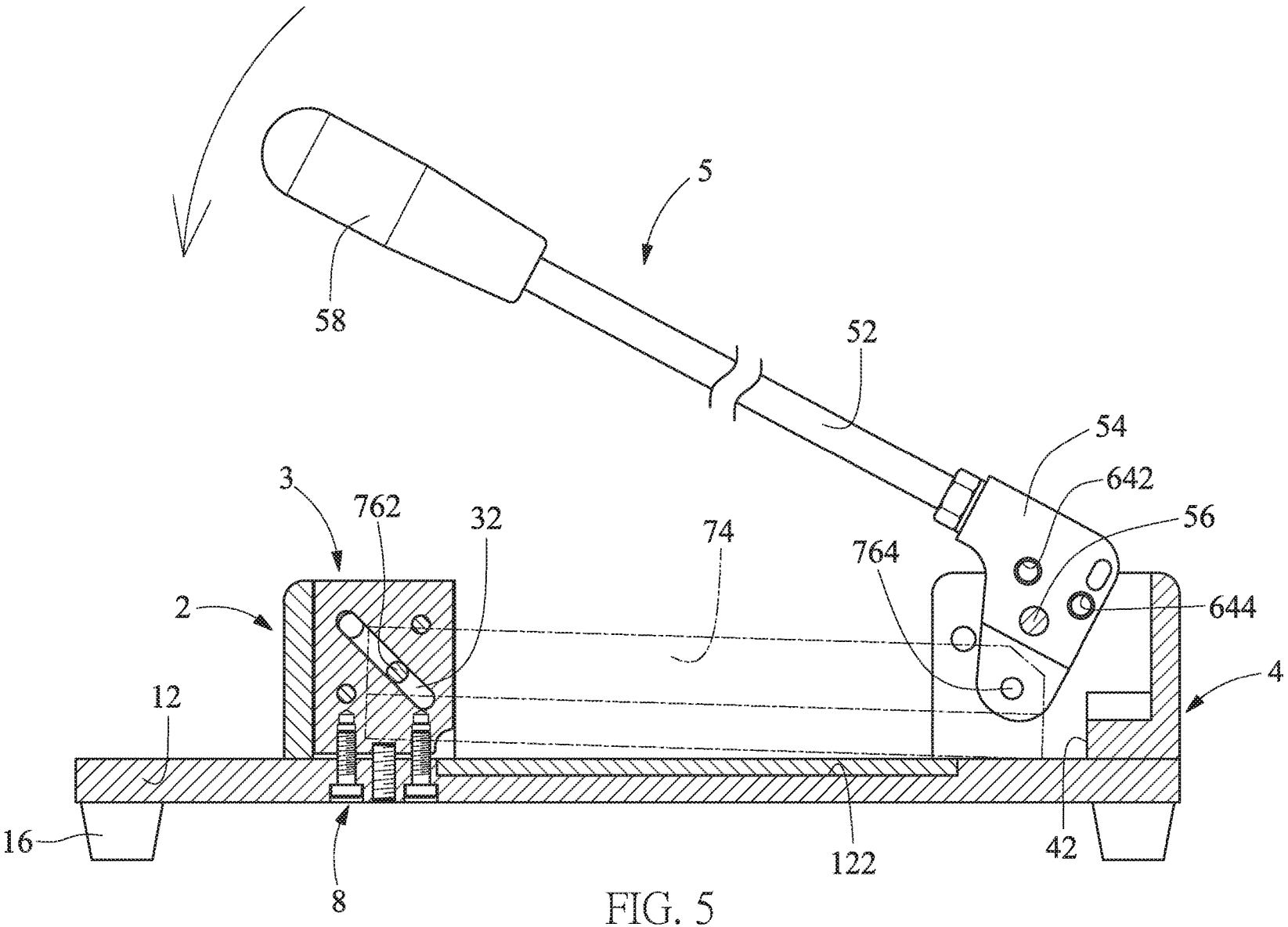
FIG. 5 is a cross-sectional view of the cutting machine in another position than shown in FIG. 4.
Figure 6:
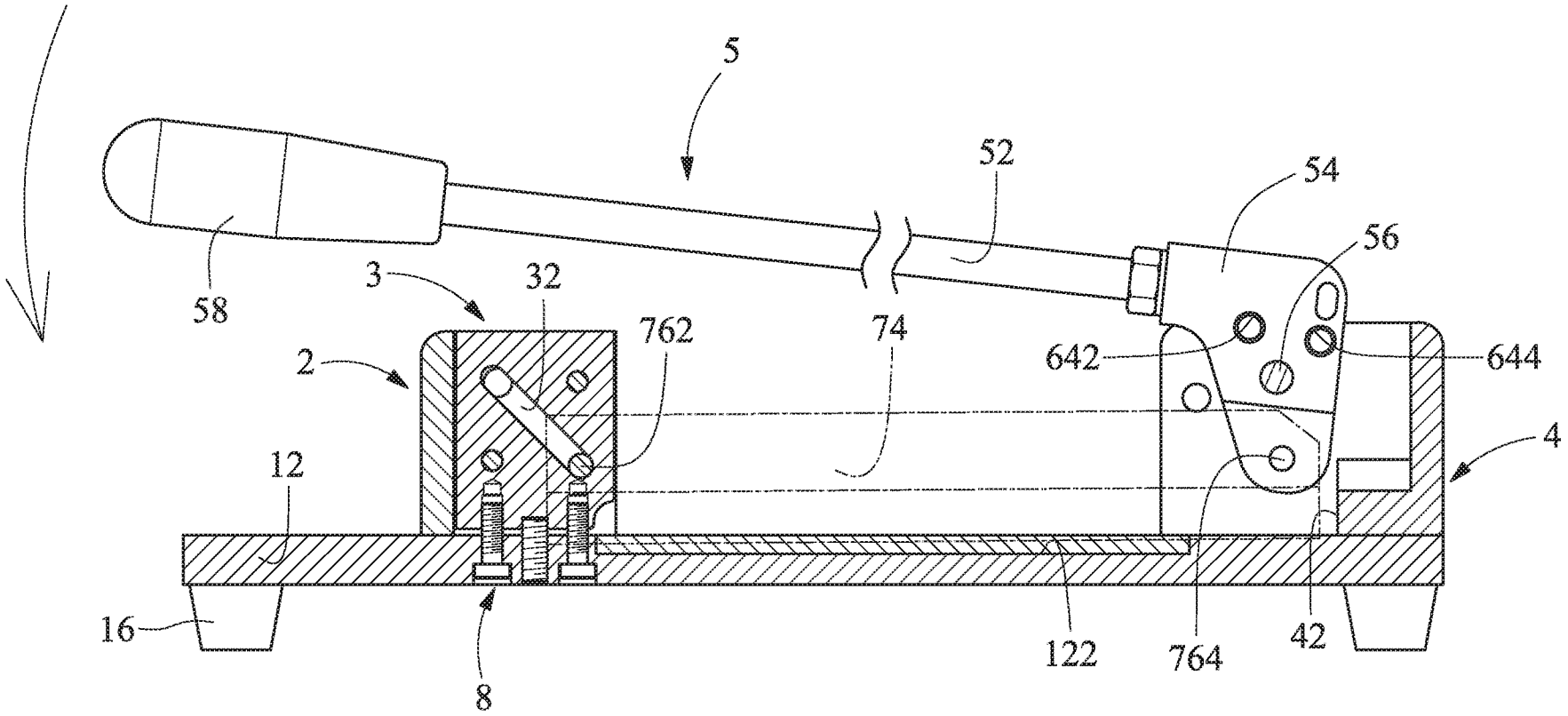
FIG. 6 is a cross-sectional view of the cutting machine in another position than shown in FIG. 5.

Referring to FIGS. 1 and 2, the basic assembly 1 preferably includes a platform 12, a buffering pad 14 and several anti-skid pads 16. The platform 12 includes a groove 122 made in an upper face. The buffering pad 14 is inserted in the groove 122. The anti-skid pads 16 are attached to a lower face of the platform 12. The groove 122, the buffering pad 14 and the anti-skid pads 16 can however be omitted in another embodiment.

Referring to FIGS. 1 and 2, the supporting element 2 is attached to the upper face of the platform 12 of the basic assembly 1. The supporting element 2 includes two lateral portions separated from each other by a space 22. Each of the lateral portions of the supporting element 2 is made with a screw hole 24 in communication with the space 22.

Referring to FIGS. 1 and 2, the guiding plate 3 is movably inserted in the space 22. The supporting element 2 is used to keep the guiding plate 3 in position. The guiding plate 3 is a substantially a rectangular plate made with a slot 32 extending along a diagonal.

Referring to FIGS. 1 and 2, the supporting element 4 is attached to the upper face of the platform 12 of the basic assembly 1, opposite to the supporting element 2. The supporting element 4 includes two lateral portions separated from each other by a space 42. Each of the lateral portions of the supporting element 4 includes a screw hole 44 and an aperture 46 in communication with the space 42. The space 42 faces the space 22. The screw hole 44 can be made with a constant diameter or two different diameters near two ends. The aperture 46 is preferably an oval aperture.

Referring to FIGS. 1 and 2, the handle 5 preferably includes a shank 52, a pivoting plate 54, an axle 56 and a grip 58. The pivoting plate 54 and the grip 58 are located at two opposite ends of the shank 52. The pivoting plate 54 is inserted in the space 42. The pivoting plate 54 includes an aperture 544 corresponding to the aperture 46. The axle 56 is inserted in the apertures 46 and 544 to pivotally connect the pivoting plate 54 to the supporting element 4. The axle 56 preferably includes a threaded portion (not numbered) engaged with a nut 561 to keep the axle 56 in the apertures 46 and 544. The grip 58 is intended to provide convenience for a user to maneuver the handle 5.

Referring to FIGS. 1 to 3 and 11 to 13, the safety assembly 6 includes a screw hole 62, two cavities 642 and 644 and a pin unit 66. The screw hole 62 is made in one of the lateral portions of the supporting element 4 so that the space 42 is in communication with the exterior of the supporting element 4 via the screw hole 62. The cavities 642 and 644 are made in a lateral face of the pivoting plate 54 of the handle 5.

The pin unit 66 includes a threaded tube 662, a pin 664, a spring 666 and a ring 668. The threaded tube 662 includes a thread (not numbered) formed on an external face and two slits 6622 in an end. The threaded tube 662 further includes a stepped tunnel (not numbered) so that a shoulder is formed on an internal face thereof. The pin 664 is inserted in the threaded tube 662. The pin 664 includes an aperture 6642 near an end and an enlarged section 6644 near another end.

By engaging the enlarged section 6644 of the pin 664 with the shoulder formed on the internal face of the threaded tube 662 and abutting the ring 668 against the threaded tube 662, the movement of the pin 664 in the threaded tube 662 is confined between a releasing position and a locking position. In the locking position, the enlarged section 6644 of the pin 664 is inserted in the cavity 642 or 644 of the pivoting plate 54 to restrain the handle 5.

The spring 666 is located around the pin 664. The spring 666 includes an end in contact with the enlarged section 6644 of the pin 664 and another end in contact with the shoulder formed on the internal face of the threaded tube 662. The spring 666 tends to keep the pin 664 in the locking position. The threaded tube 662 is inserted in the screw hole 62 of the supporting element 4. Preferably, a nut 61 is engaged with the threaded tube 662 and pressed against a lateral portion of the supporting element 4 so that the threaded tube 662 is firmly kept in position. The safety assembly 6 can however be omitted in another embodiment.

The ring 668 includes a portion inserted in the aperture 6642 so that the ring 668 is pivotally connected to the pin 664 and that the ring 668 is operable to move the pin 664 in a sense of direction. The ring 668 includes two other portions that are selectively inserted in the slits 6622 for reasons to be addressed.

Referring to FIGS. 1, 2 and 4 to 6, the blade assembly 7 includes an aperture 72, a blade 74, two pins 762 and 764 and two screws 782 and 784. The aperture 72 is made in the pivoting plate 54 of the handle 5, corresponding to the screw hole 44 of the supporting element 4.

The blade 74 is located between the supporting elements 2 and 4 and selectively pressed on the buffering pad 14. The blade 74 includes an aperture 742 near a first end and another aperture 744 near a second end located opposite to the first end.

The pins 762 and 764 are made with a diameter lager than that of a smaller one of the screw holes 24 and 44 where the screw holes 24 and 44 are made with different diameters. The diameter of the pins 762 and 764 is smaller than that of the screw holes 24 and 44 where the screw holes 24 and 44 are made with a same diameter.

The pin 762 is inserted into the aperture 742 of the blade 74 and the slot 32 of the guiding plate 3 via the screw hole 24 of the supporting element 2. The pin 762 is located out of the screw hole 24 before the screw 782 is inserted in the screw hole 24 to retain the pin 762 in the aperture 742 of the blade 74 and the slot 32 of the guiding plate 3. Thus, an end of the blade 74 is movable relative to the guiding plate 3 as the pin 762 is movable in and along the slot 32.

The pin 764 is inserted in the aperture 744 of the blade 74 and the aperture 72 of the pivoting plate 54 via the screw hole 44 of the supporting element 4. The pin 764 is located out of the screw hole 44 of the supporting element 4 before the screw 784 is inserted in the screw hole 44 to keep the pin 764 in the aperture 744 of the blade 74 and the aperture 72 of the pivoting plate 54. When the handle 5 is pivoted about the axle 56, the pivoting plate 54 moves the second end of the blade 74 up and down and synchronously moves the first end of the blade 74 relative to the guiding plate 3 as the pin 762 is movable in and along the slot 32.

Referring to FIGS. 4 to 8, the adjusting assembly 8 includes two screw holes 82, a screw hole 84, a bore 86, two bores 87, two aligning screws 89, and an adjusting screw 88. The screw holes 82 and 84 are made in the platform 12, below the guiding plate 3. The screw hole 84 is located between the screw holes 82. The bore 86 is made in the guiding plate 3, corresponding to the screw hole 84. The bores 87 are made in the guiding plate 3, corresponding to the screw holes 82. The aligning screws 89 are inserted in the screw holes 82 and the bores 87. The adjusting screw 88 is inserted in the screw hole 84 and the bore 86. An upper end of the adjusting screw 88 is in contact with a closed upper end of the bore 86. Thus, the adjusting screw 88 is rotatable to move the guiding plate 3 relative to the platform 12 and the supporting element 2. Each of the adjusting screws 88 can be made with or without an enlarged head. Each of the aligning screws 89 is made with an enlarged head.

Referring to FIGS. 4 to 6, 9 and 10, the adjusting assembly 9 includes two screw holes 92 and two adjusting screws 94. Each of the screw holes 92 is made in an upper face of a corresponding lateral portion of the supporting element 4. Each of the screw holes 92 is in communication with a corresponding aperture 46, with an axis of the former extending perpendicular to that of the latter. The adjusting screws 94 are inserted in the screw holes 92. The adjusting screws 94 are rotatable to adjust the elevation of the axle 56.

Referring to FIGS. 1 through 6, to cut paper, paper is located between the blade 74 and the platform 12 before the grip 58 is maneuvered to pivot the handle 5, which includes the pivoting plate 54, down about the axle 56. Thus, the second end of the blade 74 is moved down, and the first end of the blade 74 is moved down as the pin 762 is movable down in and along the slot 32 of the guiding plate 3. Hence, the cutting edge of the blade 74 cuts the paper before it abuts against the buffering pad 14. Thus, the buffering pad 14 protects the blade 74 and the platform 12 from each other. After the paper is cut, the grip 58 is operated to pivot the handle 5 up and synchronously raise the blade 74.

The blade 74 allows a user to cut paper efficiently. However, the cutting edge of the blade 74 will become blunt and must be sharpened after some time of use. To this end, the screws 782 and 784 are removed from the screw holes 24 and 44 before the pins 762 and 764 are removed from the apertures 742 and 744 to allow the blade 74 to be removed from the supporting elements 2 and 4. Hence, the cutting edge of the blade 74 can be sharpened.

To connect the blade 74 to the supporting elements 2 and 4 again, the first and second ends of the blade 74 are inserted in the spaces 22 and 42 of the supporting elements 2 and 4. The pins 762 and 764 are inserted in the holes 742 and 744. Then, the screws 782 and 784 are inserted in the screw holes 24 and 44. The pin 762 is inserted in the slot 32 of the guiding plate 3.

The height of the blade 74 is inevitably reduced after the cutting edge of the blade 74 is sharpened. Hence, the distance of the cutting edge of the blade 74 from the platform 12 is enlarged or becomes inconstant from an end to the other. To compensate such increase or inconsistency, the adjusting assemblies 8 and 9 can be operated to change the elevation and/or angle of the blade 74 so that the cutting edge of the blade 74 is at a proper and constant distance from the platform 12.

Figure 7:
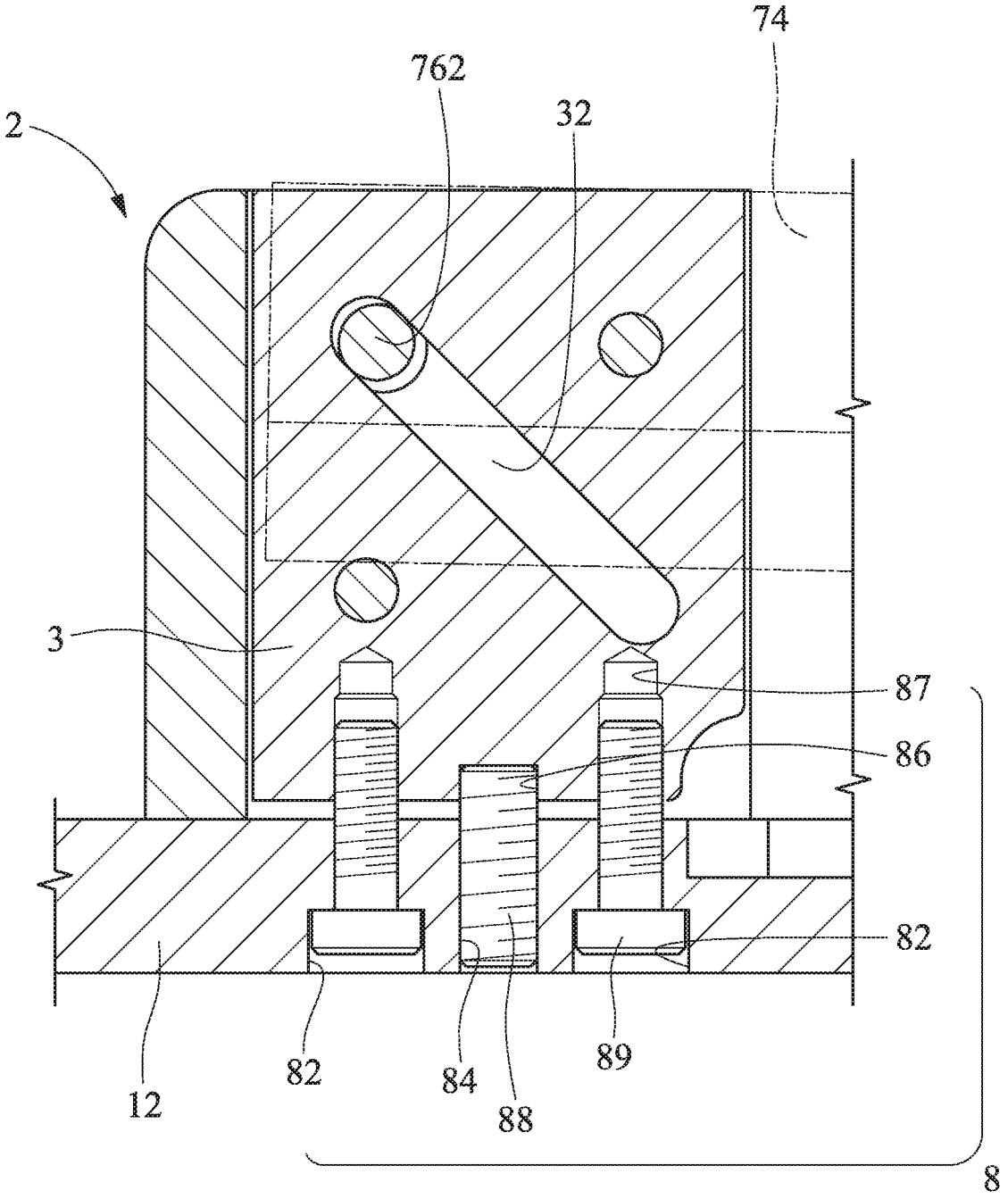
FIG. 7 is another cross-sectional view of the cutting machine shown in FIG. 4.
Figure 8:
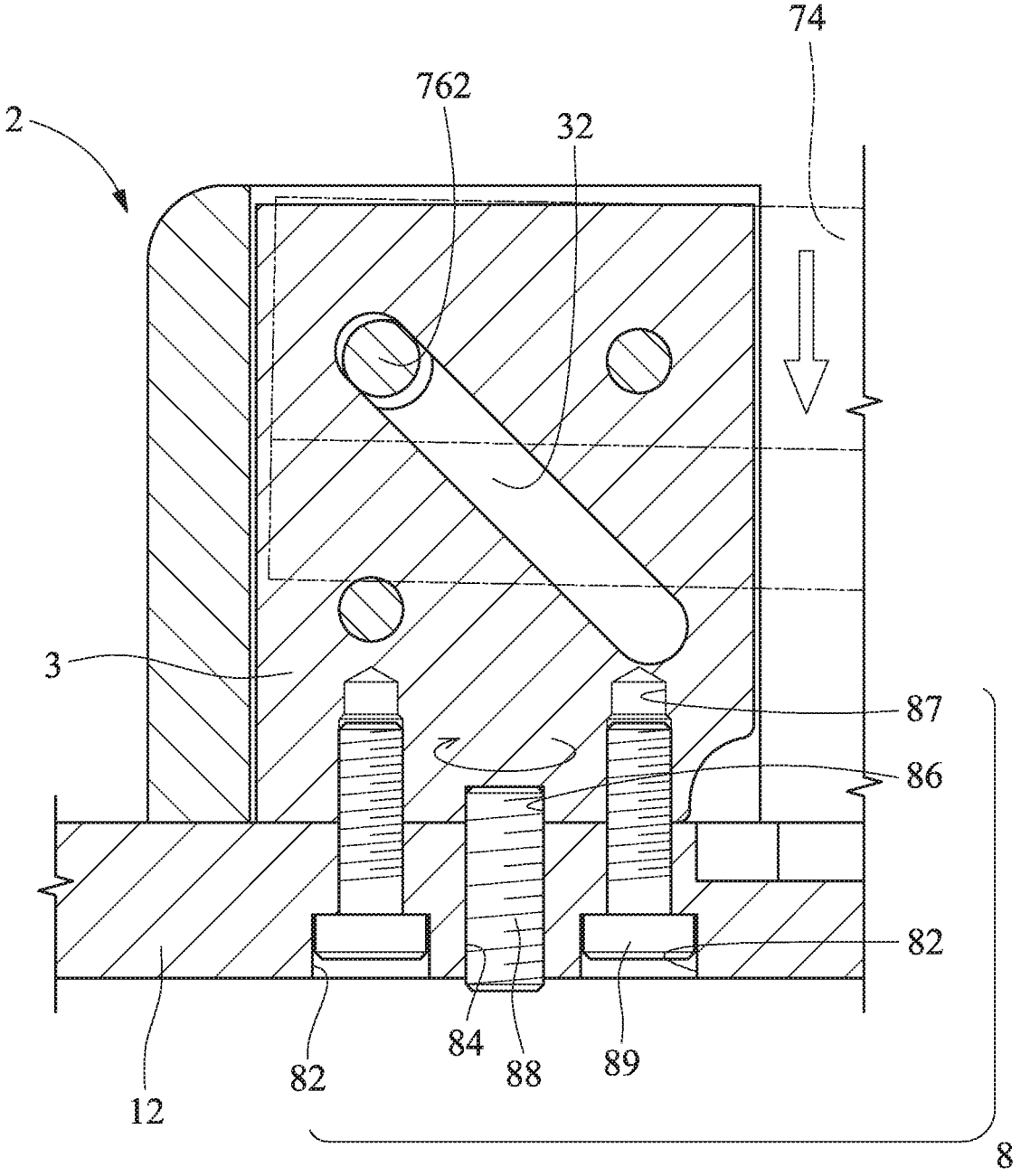
FIG. 8 is a cross-sectional view of the cutting machine in another position than shown in FIG. 7.

The operation of the adjusting assembly 8 will be described. Referring to FIG. 7, the adjusting screw 88 is rotatable in a sense of direction to allow the upper end thereof to push and raise the guiding plate 3, thereby raising the first end of the blade 74. Referring to FIG. 8, the adjusting screw 88 is rotatable in an opposite sense of direction to lower the upper end thereof to allow the guiding plate 3 to fall because of the gravity, thereby lowering the first end of the blade 74.

Figure 9:
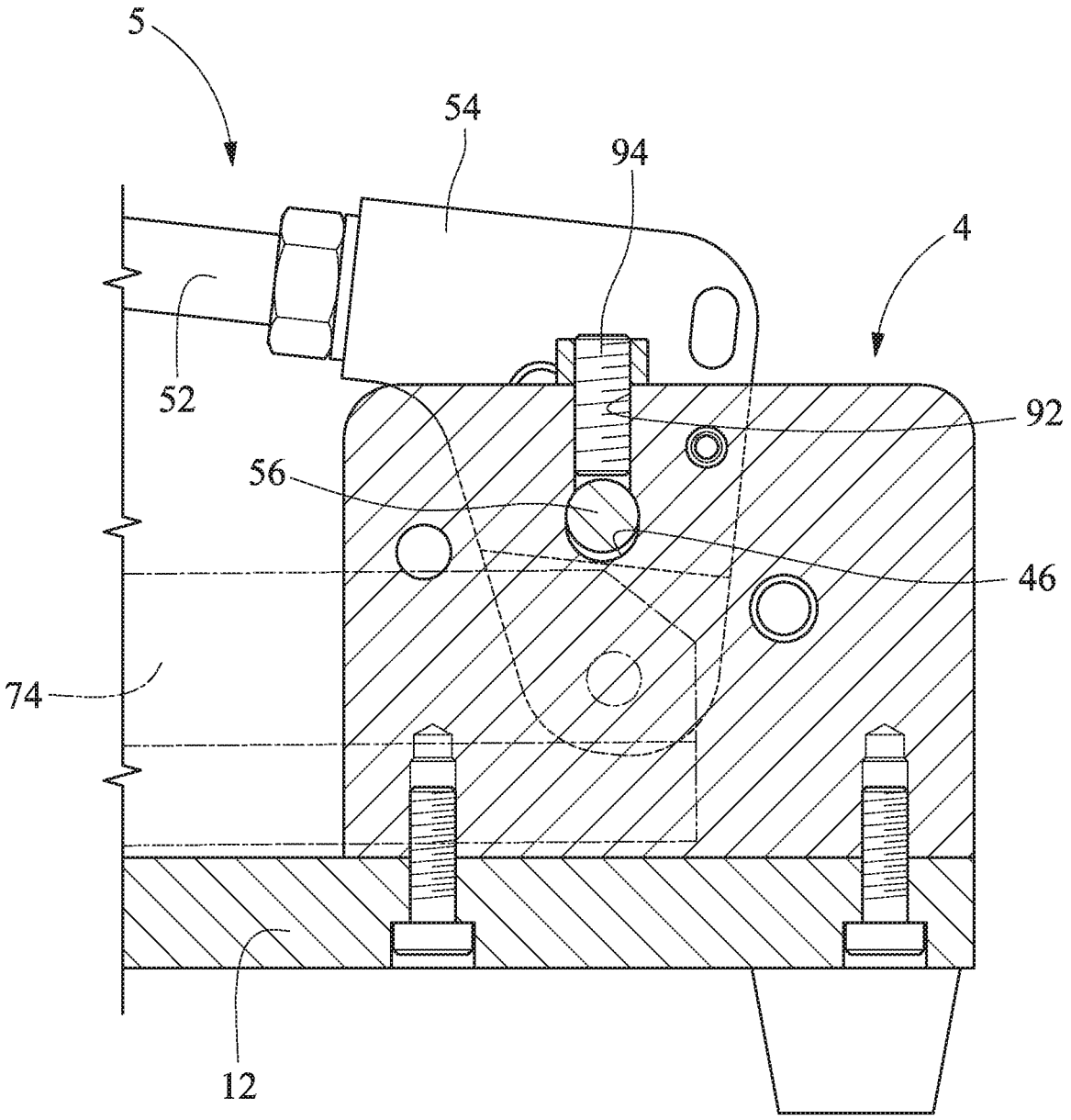
FIG. 9 is another cross-sectional view of the cutting machine shown in FIG. 4.
Figure 10:
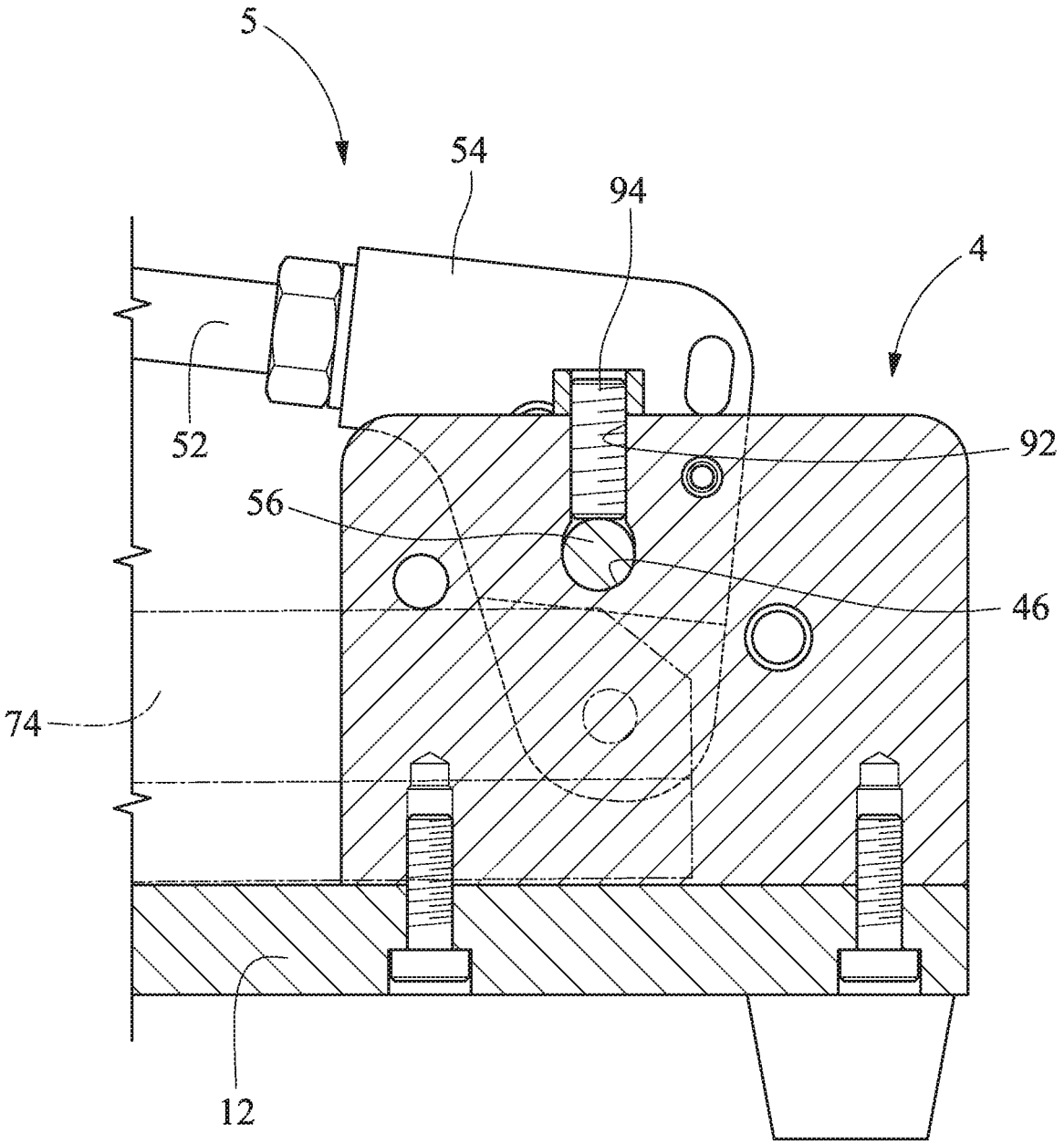
FIG. 10 is a cross-sectional view of the cutting machine in another position than shown in FIG. 9.

The operation of the adjusting assembly 9 will be described. Firstly, the handle 5 is pivoted down about the axle 56, and so is the pivoting plate 54. Thus, the blade 74 is moved down and placed against the buffering pad 14. The axle 56, which is inserted in the aperture 544 of the pivoting plate 54, is moved to the uppermost position in the aperture 46 of the supporting element 4. Referring to FIG. 9, the adjusting screws 94 are rotatable in a sense of direction to raise and remove the lower ends thereof from the axle 56 and the second end of the blade 74. Referring to FIG. 10, the adjusting screws 94 are rotated in an opposite sense of direction to lower and cause the lower ends thereof to push and lower the axle 56 and the second end of the blade 74.

Figure 11:
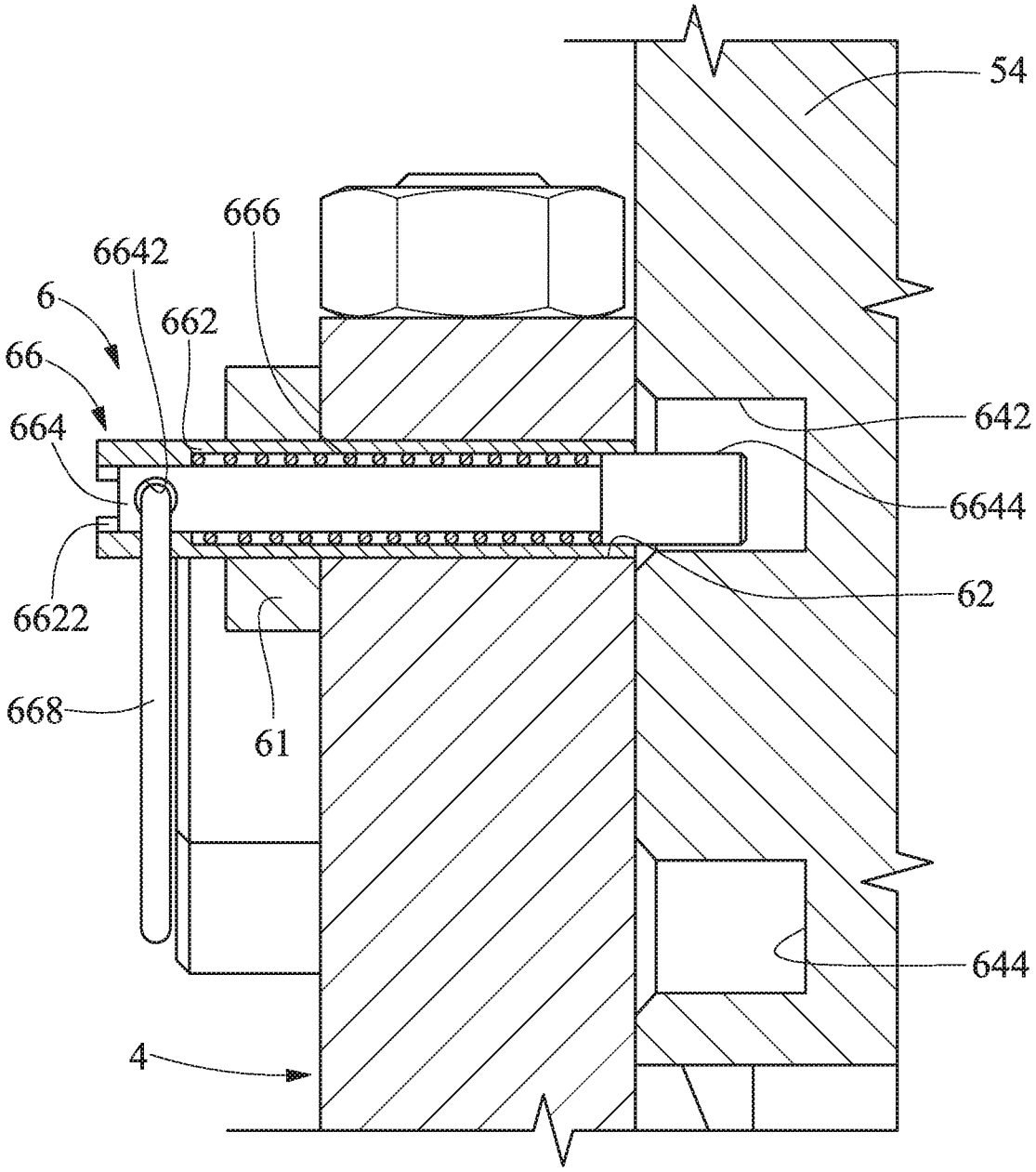
FIG. 11 is a cross-sectional view of the cutting machine of FIG. 3.

Referring to FIGS. 1 and 11, the handle 5 is kept perpendicular to the platform 12 by the safety assembly 6 in the locking position. Hence, the handle 5 cannot be maneuvered to move the blade assembly 7. In detail, the spring 666 of the safety assembly 6 abuts against an end of the enlarged section 6644 of the pin 664 so that another end of the enlarged section 6644 of the pin 664 is inserted in the cavity 642. The pin unit 66 is inserted in the cavity 642 of the pivoting plate 54 and the screw hole 62 of the supporting element 4, thereby preventing the handle 5 from pivoting relative to the supporting element 4. The ring 668 is inserted in the slits 6622.

Alternatively, the handle 5 can be kept substantially parallel to the platform 12 by the safety assembly 6 in the locking position. In detail, the spring 666 of the safety assembly 6 abuts against an end of the enlarged section 6644 of the pin 664 so that another end of the enlarged section 6644 of the pin 664 is inserted in the cavity 644. The pin unit 66 is inserted in the cavity 644 of the pivoting plate 54 and the screw hole 62 of the supporting element 4, thereby preventing the handle 5 from pivoting relative to the supporting element 4.

Figure 12:
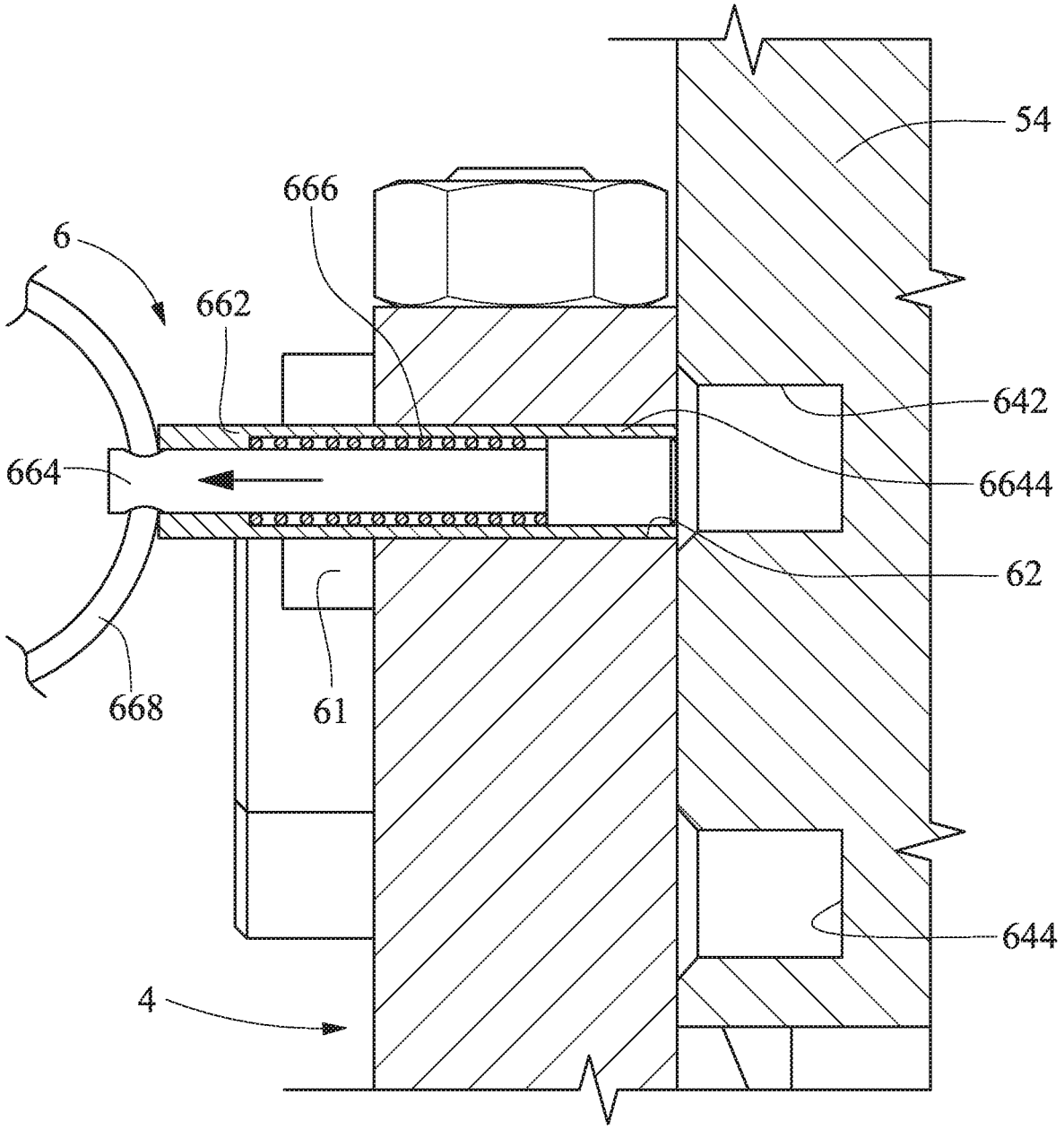
FIG. 12 is a cross-sectional view of the cutting machine in another position than shown in FIG. 11.

Referring to FIG. 12, the ring 668 is pulled to move the pin 664 from the cavity 642 or 644 of the pivoting plate 54 to move the safety assembly 6 to the releasing position from the locking position. Then, the ring 668 is rotated about an axis of the pin 664 and placed against an end of the threaded tube 662. Thus, the pin 664 is kept out of the cavity 642 or 644 of the pivoting plate 54 and the safety assembly 6 is retained in the releasing position. Hence, the handle 5 is operable to pivot the blade 74 to cut paper.

The present invention has been described via the illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A cutting machine comprising:

a platform (12);

a first supporting element (2) supported on the platform (12) and made with a space (22) and a screw hole (24);

a guiding plate (3) inserted in the space (22) so that the guiding plate (3) is stationary relative to the first supporting element (2) and made with a slot (32);

a second supporting element (4) supported on the platform (12) and made with a screw hole (44), a space (42) facing the space (22) of the first supporting element (2) and an aperture (46) in communication with the space (42) thereof;

a handle (5) comprising:

a pivoting plate (54) formed at an end, inserted in the space (42) of the second supporting element (4), and made with a primary aperture (544) and a secondary aperture (72); and an axle (56) inserted in the primary aperture (544) of the pivoting plate (54) and movably inserted in the aperture (46) of the second supporting element (4); and a blade assembly (7) comprising:

a blade (74) made with a first aperture (742) near an end and a second aperture (744) near another end;

a first pin (762) inserted in the first aperture (742) of the blade (74) and movably inserted in the slot (32) through the screw hole (24) of the first supporting element (2);

a first screw (782) inserted in the screw hole (24) of the first supporting element (2) to keep the first pin (762) out of the screw hole (24) and in the first aperture (742) of the blade (74) and the slot (32);

a second pin (764) inserted in the second aperture (744) of the blade (74) and the secondary aperture (72) of the pivoting plate (54) through the screw hole (44) of the second supporting element (4); and a second screw (784) inserted in the screw hole (44) of the second supporting element (4) to abut against and hence keep the second pin (764) in the second aperture (744) of the blade (74) and the secondary aperture (72) of the pivoting plate (54).

2. The cutting machine according to claim 1, wherein aperture (46) of the second supporting element (4) is an oval aperture.

3. The cutting machine according to claim 1, further comprising a first adjusting assembly (8) comprising:

a screw hole (84) made in the platform (12); and an adjusting screw (88) inserted in the screw hole (84) and made with an end in contact with the sliding plate (3).

4. The cutting machine according to claim 1, further comprising a second adjusting assembly comprising:

a screw hole (92) made in the second supporting element (4) and in communication with the aperture (46) of the second supporting element (4); and a screw (94) inserted in the screw hole (92) and made with an end adapted for abutment against the axle (56), which is inserted in the aperture (46) of the second supporting element (4).

5. The cutting machine according to claim 1, further comprising a safety assembly (6) comprising:

at least one cavity (642) made in the pivoting plate (54); and a pin unit (66) movably connected to the second supporting element (4) between a locking position where the pin unit (66) is inserted in the cavity (642) and a releasing position where the pin unit (66) is located out of the cavity (642).

6. The cutting machine according to claim 5, wherein the pin unit (66) comprises:

a threaded tube (662) inserted in a screw hole (62) made in the second supporting element (4);

a pin (664) movably inserted in the threaded tube (662) and made with:

a first section (6644) for insertion in the cavity (642) when the pin unit (66) is in the locking position; and a second section for extension out of the threaded tube (662) when the pin unit (66) is in the releasing position;

a spring (666) inserted in the threaded tube (662) and compressed between a portion of the pin (664) and an internal portion of the threaded tube (662) so that the spring (666) tends to keep the first section (6644) of the pin (664) in the cavity (642); and a ring (668) pivotally connected to the second section of the pin (664) and operable to pull the pin (664) by the second section, thereby moving the first section (6644) of the pin (664) from the cavity (642).

7. The cutting machine according to claim 6, wherein the first section (6644) of the pin (664) is an enlarged section.

8. The cutting machine according to claim 6, wherein the threaded tube (662) comprises:

an external end located out of the second supporting element (4) and adapted for abutting against the ring (668), thereby keeping the first section (6644) of the pin (664) out of the cavity (642); and two slits (6622) made in the external end and adapted for receiving the ring (668) when the first section (6644) of the pin (664) is in the cavity (642).

9. The cutting machine according to claim 8, wherein the ring (668) is rotated about an axis of the pin (664) after it is moved out of the slits (6622) and before it is abutted against the external end of the threaded tube (662).

10. The cutting machine according to claim 1, wherein the platform (12) comprises:

a groove (122) made in an upper face; and a buffering pad (14) inserted in the groove (122) and adapted for contact with the blade (74).

11. The cutting machine according to claim 1, wherein the handle (5) further includes a grip (58) formed at an opposite end.

12. The cutting machine according to claim 1, wherein the slot (32) extends along a diagonal of the sliding plate (3).

* * * * *